United States Patent [19]

Frazita et al.

[11] Patent Number: 4,999,639

[45] Date of Patent: Mar. 12, 1991

[54] RADOME HAVING INTEGRAL HEATING AND IMPEDANCE MATCHING ELEMENTS

[75] Inventors: Richard F. Frazita, Saint James; Alfred R. Lopez, Commack, both of N.Y.

[73] Assignee: Hazeltine Corporation, Greenlawn, N.Y.

[21] Appl. No.: 318,304

[22] Filed: Mar. 3, 1989

[51] Int. Cl.[5] ..... H01Q 1/02

[52] U.S. Cl. ..... 343/704; 343/771; 343/872

[58] Field of Search ..... 343/704, 771, 872

[56] References Cited

U.S. PATENT DOCUMENTS

| | | | |
|---|---|---|---|
| 2,567,804 | 9/1951 | Davies | 343/704 |
| 2,712,604 | 7/1955 | Thomas et al. | 343/704 |
| 3,146,449 | 8/1964 | Serge et al. | 343/704 |
| 3,805,017 | 4/1974 | Roberts et al. | 343/704 |
| 3,995,274 | 11/1976 | Schwartz et al. | 343/771 |
| 4,031,537 | 6/1977 | Alford | 343/704 |
| 4,213,029 | 7/1980 | Endicott et al. | 343/704 |

*Primary Examiner*—Rolf Hille
*Assistant Examiner*—Hoanganh Le
*Attorney, Agent, or Firm*—E. A. Onders

[57] ABSTRACT

An antenna radome, suitable for use with high precision, environmentally sensitive array antennas, includes a dielectric sheet formed to protect the antenna from environmental conditions and a series of conductors fixed on the sheet in a certain pattern so that the sheet with the conductors provides a lower reflection coefficient to electromagnetic waves at the antenna's operating wavelength than in the absence of the conductors. Current is caused to flow through the conductors, thus generating heat in areas of the dielectric sheet where the conductors are fixed. Accordingly, ice formation on the protective dielectric sheet can be prevented while the antenna array is operational, and accurate antenna performance is ensured. Further, the dielectric sheet presents a significantly lower reflection coefficient at the operating wavelength than radomes in which a conventional grid of heater wires is provided for melting ice.

23 Claims, 2 Drawing Sheets

RADOME HAVING INTEGRAL HEATING AND IMPEDANCE MATCHING ELEMENTS

FIELD OF THE INVENTION

The present invention relates generally to antenna radomes, and particularly to radome construction providing both low loss and de-icing capability for precision antenna installations at environmentally severe locations.

BACKGROUND OF THE INVENTION

Antenna radomes which include heating wires are generally known. Such radomes may include a grid of high resistance Inconel wires for heating the radome to prevent the formation of ice. Problems arise, however, in that the heating wires tend to increase the reflection coefficient at the surface of the radome to incident electromagnetic wave energy at the operating wavelength of the antenna. Thus, the level of energy transmitted through the radome decreases from that which would be transmitted in the absence of the heating wires. Also, depending on the spacing between adjacent wires and the operating wavelength, the free space antenna pattern may be adversely affected by the radome wires, for example, by the generation of grating lobes in the antenna pattern. Appropriate precautions must therefore be taken with respect to the heating wire grid arrangement. To ensure system compatibility, it may be necessary to provide suitable compensation to signals transmitted or received by the antenna as a function of the antenna scan angle relative to the radome. It may in some cases even be impossible to obtain adequate radome heating capability owing to limitations imposed on the heating wire configuration at a given operating wavelength and degree of scan.

It is also generally known that highly conductive wires (e.g. copper), when arranged in a certain pattern on or parallel to a major surface of an antenna radome, will serve to enhance the impedance match between the radome material and the surrounding space. A radome having a thickness that is small compared to the antenna's operating wavelength will exhibit a capacitive susceptance to incident electromagnetic wave energy. The inherent capacitive susceptance of the radome material can be cancelled by introducing a corresponding inductive susceptance to the radome by the use of conductive wires that follow a meandering path in a plane parallel to the surface of the radome.

As far as is known, no attempts have been made to use conductive wires arranged on or in a radome for purposes of impedance matching and also as a means for generating heat sufficient to de-ice the radome during severe weather conditions.

It is, therefore, an object of the present invention to overcome the above and other shortcomings in the known heated radome constructions.

Another object of the invention is to provide an antenna radome construction that affords the desirable features of a heated radome and also is well matched to the surrounding space at a given operating wavelength and over a wide range of antenna scan angles.

A further object of the invention is to provide a heated and matched antenna radome suitable for use with precision antenna installations at environmentally severe locations.

Another object of the invention is to provide a radome construction with both heating and matching capabilities, and one that does not necessitate complex means for antenna signal compensation over a given scan angle range.

Yet another object of the invention is to provide an antenna radome with both heating and matching capabilities, that exhibits a relatively high frequency bandwidth ratio with respect to a given antenna operating wavelength.

SUMMARY OF THE INVENTION

According to the invention, an antenna radome includes a dielectric member shaped to protect an antenna from environmental conditions, and a plurality of conductors fixed in relation to a major surface of said dielectric member in a predetermined patter so that the member with the conductors provides a lower reflection coefficient to incident electromagnetic waves at the operating wavelength of the antenna than in the absence of the conductors. Means are provided for causing a desired heating current to flow through the conductors, thereby enabling heat to be generated in the dielectric member.

According to another aspect of the invention, an environmentally stable antenna system comprises an array of antenna elements fixed relative to one another to obtain a desired array pattern when the elements are excited with radio frequency energy of a certain wavelength and relative phase shift. A dielectric sheet is used to protect the array of elements from environmental conditions, and means are provided for supporting the sheet in protective relation to the array. A plurality of conductors are fixed in relation to a major surface of said dielectric sheet in a predetermined pattern so that the combination of the sheet with the conductors provides a lower reflection coefficient to electromagnetic wave energy at the operating wave length of the array than in the absence of the conductors. Means are provided for applying a voltage across opposite ends of the conductors thereby enabling heat to be generated in the dielectric sheet as a result of a heating current flowing through the conductors.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
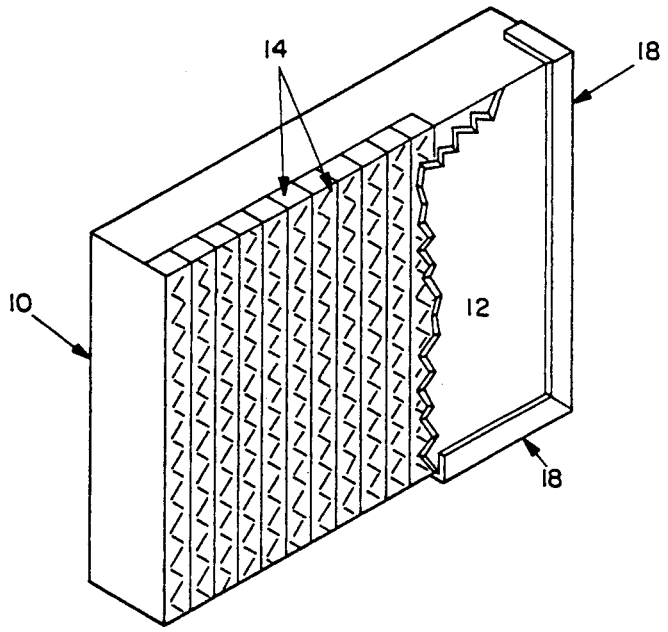
FIG. 1 is a perspective view of an antenna array including a radome constructed according to the present invention.

FIG. 1 is a perspective view of a planar array antenna 10 including a radome 12 constructed according to the present invention.

Antenna 10 may be, for example, an azimuth (AZ) antenna of the kind used in microwave landing systems (MLS). Such an antenna is generally a planar rectangular array of vertically oriented, slotted wave guides 14 supported adjacent one another and measuring about 5 feet in height and about 14 feet in width.

The invention is not limited to use with the particular antenna 10 represented in FIG. 1 and may be used with other antennas, such as a line array elevation antenna (EL) used in MLS and other non array antennas.

Until now, it has been the practice to equip radomes for MLS antennas with a grid of Inconel wires to prevent ice from forming on the outer surface of the radome. Any ice allowed to form on the surface of the radome 12 in FIG. 1 during operation of the antenna 10 would adversely affect the antenna's performance. In a MLS installation, for example, the AZ antenna scans a main beam of electromagnetic wave energy (at a wavelength $\lambda_o$ of about 2.33 inches) rapidly "to" and "fro" over an azimuth scan angle of, typically, plus and minus 40 degrees with respect to the runway centerline. The EL antenna in a MLS installation scans its beam rapidly "up" and "down" over an elevation scan angle typically from about 1 degree to 15 degrees relative to the runway. An MLS receiver on board an aircraft approaching the runway receives the beams as scanned by the AZ and EL antennas and calculates the aircraft's heading and angle of descent relative to the runway.

Any malfunction of the MLS antennas, such as may be caused by icing and/or displacement of the radome 12 relative to the antenna elements due to misalignment or motion from highwinds, can cause the aforementioned electronically steered beams from the antennas to deviate from their precise location in space. Such deviations may cause significant errors in the positional information derived by the aircraft's MLS receiver during the critical time when the aircraft is approaching the runway.

Rather than employ the prior art grid of Inconel heater wires arranged perpendicular to the incident FR electric field as a means for preventing ice formation on the radome 12, it has been discovered that a predetermined pattern of conductors (FIG. 2) may be used in a dual role both as a means for generating de-icing heat and for enhancing, rather than degrading, the impedance match of the radome material with the surrounding space. By reducing the reflection coefficient of the radome 12 to electromagnetic energy at the operating wavelength of the antenna 10 through use of conductors 16, from that obtained in the absence of conductors 16 or when a conventional grid of heating wires is used, any Permanent misalignment or movement of theradome 12 relative to the antenna elements 12 will also have less effect on the actual antenna pattern. MLS position errors, introduced by such radome misalignment or movement in the prior installations, will be significantly reduced as the radome 12 itself appears more like free space in its transmission characteristics.

In the embodiment illustrated in FIG. 1, the reflection coefficient of the radome 12 is reduced to −36 dB from a prior level of −23 dB for radomes employing Inconel heater wires. In the antenna 10 of FIG. 1, the radome 12 is supported by suitable brackets 18 so as to extend about 4 inches in front of the slotted waveguides 14. The brackets 18 fix the radome 12 in position parallel to the antenna elements or waveguides 14 in the direction of the scan plane and apply some tension to the radome 12 to prevent undesirable movement during high wind conditions.

Figure 3:
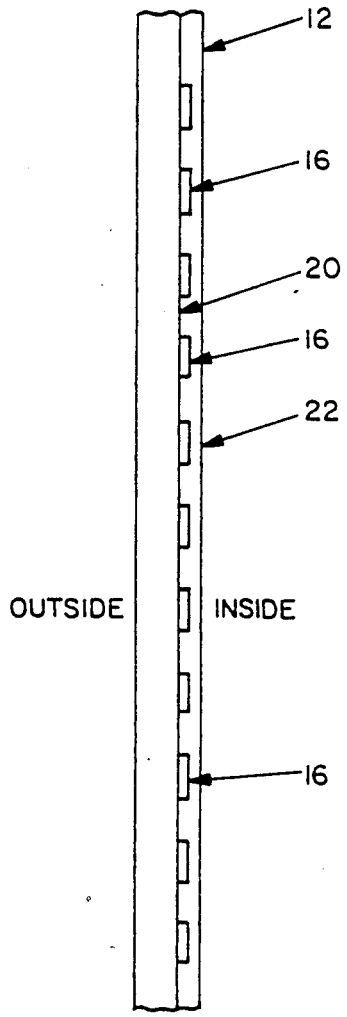
FIG. 3 is an enlarged cross-sectional view taken along line A—A in FIG. 2.

As shown in the embodiment illustrated in FIG. 3, radome 12 may be a dielectric sheet formed of layers 20 and 22. Layer 20 may be teflon cloth, such as Raydel type M-26, 0.018 inches thick, for example, Layer 22 may be Chemfab Skrimcloth (fiberglass), for example. When bonded by a suitable adhesive such as 3M No 2290 (EPOXY), the two layers 20, 22 form the sheet radome 12 with a thickness of about 0.025 inches. Teflon cloth is preferred as the outside layer (the one exposed to weather) because of its ability to shed water.

Conductors 16 are printed or otherwise fixed on one of the major surfaces of the radome layers 20, 22 and preferably are sandwiched between the layers when the layers are bonded to one another as shown in FIG. 3.

Figure 4:
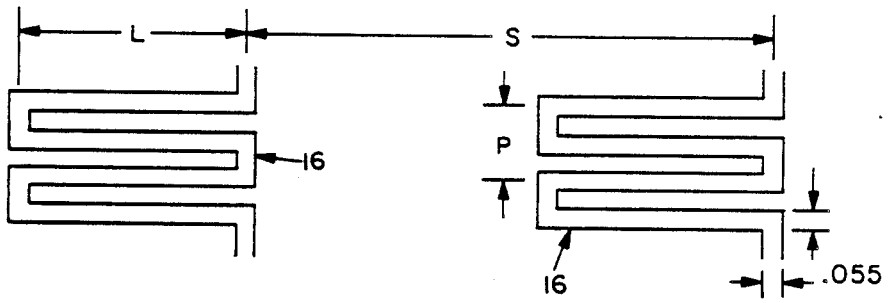
FIG. 4 is an enlarged detail view of a part of the radome in FIG. 2.
Figure 2:
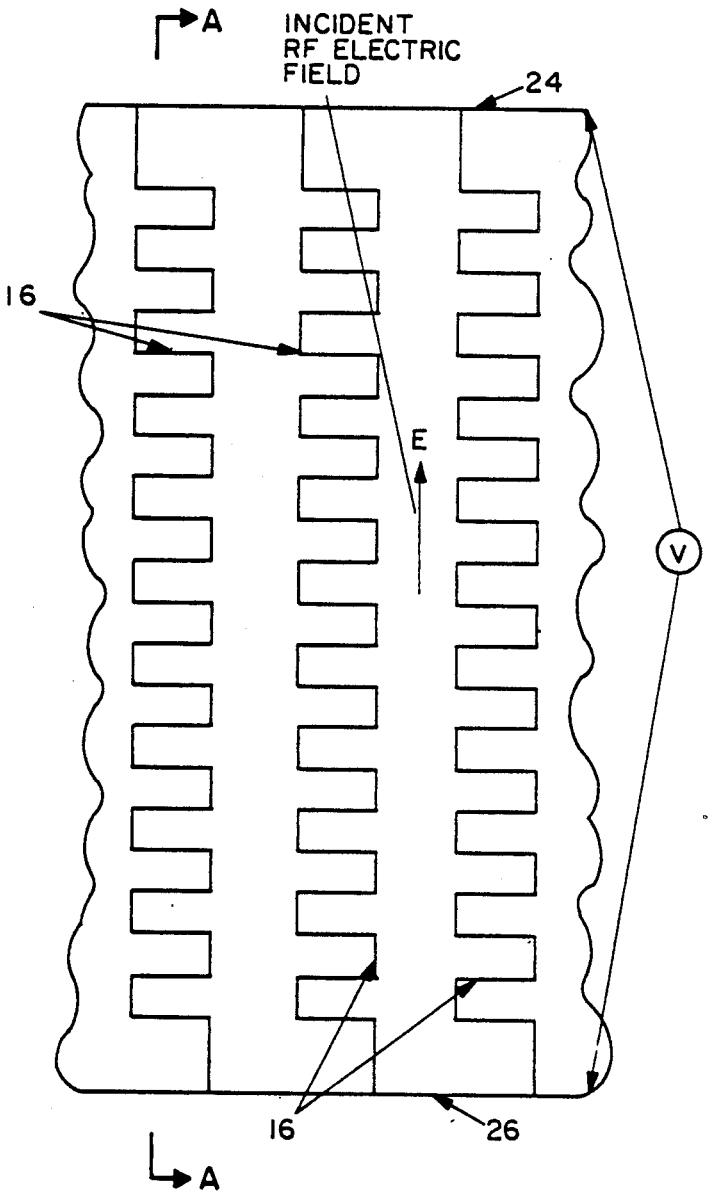
FIG. 2 is a plan view of a portion of the radome in FIG. 1.

In the illustrated embodiment, each of the conductors 16 follows a meandering path as shown in FIGS. 2 and 4. Specifically, conductors 16 run parallel to one another and are spaced apart by a distance at most 1/2 the operating wavelength of the antenna 10. Each of the conductors 16 extends generally in a direction parallel to the E field of electromagnetic wave energy that will be encountered during antenna operation. The maximum spacing limit for conductors 16 prevents undesirable grating lobes from appearing in the radiation pattern of antenna 10 as its beam scans relative to the radome 12.

At opposite ends of each of the parallel, meandering conductors 16 are connected terminal bus lines 24, 26 which enable a voltage from a source V (FIG. 2) to be applied across opposite ends of the conductors 16. The applied voltage causes a heating current to pass through the conductors and generate heat in the radome 12. The heating current should be sufficient to prevent ice formation on the outside surface of theradome 12. The voltage source V may be an AC source located conveniently close to the antenna installation, and typically might have a capacity of several kilowatts or higher.

The conductors 16 are preferably in the form of flat copper strips about 0.055 inches wide, as shown in FIG. 4. A typical heating current for each conductor 16 is then about one-quarter amp. However, other dimensions and conductive materials may be used.

For an operating wavelength of about 2.33 inches, such as used in typical MLS installations, the spacing S between adjacent conductors 16 is preferably about one inch. The length L of inductive regions of the conductors 16 is preferably about 0.418 inch, and the periodicity P of successive inductive regions along the path of each conductor 16 is about 0.218 inch.

It will, of course, be understood that the foregoing dimensions for conductors 16 be may varied, depending on the operating wavelength of the antenna with which the radome 12 is used.

The frequency-bandwidth ratio for radome 12, having a desired reflection coefficient and dielectric constant, can be derived as shown below.

The normalized capacitive susceptance for a dielectric sheet is given by $$B=(k-1)2\pi(t/\lambda_o)(f/f_o), \quad (1)$$

wherein $k$ = dielectric constant $\lambda_o$ = free space wavelength $f$ = frequency $f_o$ = reference frequency $t$ = dielectric thickness The susceptance for radome 12, including the inductive contribution of the wires 16, then becomes:

$$B=(k-1)2\pi(t/\lambda_o)[(f/f_o)-(f_o/f)] \quad (2)$$

$$B=(k-1)2\pi(t/\lambda_o)BW, \quad (3)$$

where

BW = frequency bandwidth ratio.

The reflection coefficient is given by $$p=\frac{1-(jB+1)}{1+(jB+1)} \quad (4)$$

$$p\approx -jB/2 \quad (5)$$

$$p=(k-1)(\pi/\lambda_o)tBW. \quad (6)$$

For p=0.0158(−36 dB)

k=3 t=0.025"

$\lambda_o$=2.333",

BW=0.255 or 25.5%

In MLS installations, the operational bandwidth ratio is usually taken to be 0.012 or 1.2%. The excess bandwidth afforded by the present radome 12 (24.4%) provides a comfortable margin, such as is desirable required for manufacturing and material tolerances.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. An antenna radome, for use in conjunction with an antenna designed to emit electromagnetic waves at a given wavelength and having an E field component, comprising:

a dielectric member formed to protect said antenna from environmental conditions;

a plurality of conductors arranged in a predetermined pattern on a major surface of said dielectric member such that said conductors extend generally in a direction parallel to the E field of incident electromagnetic waves from said antenna at said given wavelength and follow a predetermined meandering path, whereby the member with said conductors provides a lower reflection coefficient to incident electromagnetic waves at said given wavelength than in the absence of said conductors; and means for causing a desired heating current to flow through said conductors, thereby heating said member.

2. An antenna radome according to claim 1, wherein said conductors are copper.

3. An antenna radome according to claim 1 wherein said conductors are Inconel.

4. An antenna radome according to claim 1 wherein said conductors are in the form of flat strips.

5. An antenna radome according to claim 1, wherein said conductors are generally parallel and spaced not more than one-half said given wavelength apart from one another.

6. An antenna radome according to claim 1, wherein said given wavelength is about 2.33 inches in free space, and the dielectric member is a sheet having a dielectric constant of about 3 and a thickness of about 0.025 inches.

7. An antenna radome according to claim 6, wherein said antenna is a scanning antenna having a predetermined range of scan angles, and wherein the reflection coefficient of the combination of said dielectric sheet with said conductors, at said given wavelength, is about −30 to −36 dB over said range of scan angles.

8. An antenna radome according to claim 6, wherein said dielectric sheet exhibits a frequency bandwidth ratio of about 25 percent relative to the operating wavelength.

9. An antenna radome according to claim 1, wherein said dielectric member is a sheet formed of two thin layers and said conductors are sandwiched between the two layers.

10. An antenna radome according to claim 9, wherein said given wavelength is about 2.33 inches in free space, the thickness of one of the two layers is about 0.018 inches, the thickness of the remaining layer is about 0.007 inches, and the dielectric constant of each sheet is about 3.

11. An antenna radome according to claim 1, including means for applying a voltage across opposite ends of said conductors, thereby causing heating current to flow through said conductors at a level which generates sufficient heat to prevent formation of ice on an outside surface of the dielectric member under predetermined conditions.

12. An antenna radome according to claim 11, wherein said conductors are in the form of flat strips about 0.055 inches wide, and the heating current through each of the flat strips is about one-quarter amp.

13. An antenna radome according to claim 11, wherein said voltage applying means is an AC source.

14. An environmentally stable antenna system, comprising:

an array of linearly polarized antenna elements designed to emit electromagnetic waves of a selected wavelength and having an E field component;

a dielectric sheet formed to shield said array from weather conditions;

means for supporting said dielectric sheet generally parallel to said array and in the path of said electromagnetic waves;

a plurality of conductors arranged in a predetermined pattern on a major surface of said dielectric sheet such that such conductors extend generally in a direction parallel to the E field of incident electromagnetic waves from said array at said given wavelength and follow a predetermined meandering path, whereby the sheet with said conductors provides a lower reflection coefficient to incident electromagnetic waves at said selected wavelength than in the absence of said conductors; and means, coupled to said conductors, for applying a voltage across opposite ends of said conductors, thereby heating the dielectric sheet in response to a heating current passing through said conductors.

15. The antenna system of claim 14, wherein said conductors are copper.

16. The antenna system of claim 14, wherein said conductors are Inconel.

17. The antenna system of claim 14, wherein said conductors are flat strips.

18. The antenna system of claim 14, wherein said conductors are generally parallel and spaced not more than one-half said selected wavelength apart from one another.

19. The antenna system of claim 14, wherein said selected wavelength is about 2.33 inches in free space, and the dielectric sheet has a dielectric constant of about 3 and a thickness of about 0.025 inches.

20. The antenna system of claim 19, wherein the reflection coefficient of the dielectric sheet with the conductors at said certain wavelength is about −30 dB to −36 dB.

21. The antenna system of claim 19, wherein the dielectric sheet with said conductors exhibits a frequency bandwidth ratio of about 25 percent relative to said certain wavelength.

22. The antenna system of claim 14, wherein the dielectric sheet is formed of two layers and the said conductors are sandwiched between the two layers.

23. The antenna system of claim 14, wherein said conductors are flat strips about 0.055 inches wide, and the heating current through each of the flat strips is about one-quarter amp.

* * * * *

UNITED STATES PATENT AND TRADEMARK OFFICE

CERTIFICATE OF CORRECTION

PATENT NO. : 4,999,639

DATED : MARCH 12, 1991

INVENTOR(S) : RICHARD F. FRAZITA; ALFRED R. LOPEZ

It is certified that error appears in the above-identified patent and that said Letters Patent is hereby corrected as shown below:

Column 6, Line 49, after "such that" delete "such" and insert "said"

Signed and Sealed this

Eleventh Day of August, 1992

*Attest:*

DOUGLAS B. COMER

*Attesting Officer*

*Acting Commissioner of Patents and Trademarks*